US005540289A

United States Patent [19]

Hirooka et al.

[11] Patent Number: 5,540,289

[45] Date of Patent: Jul. 30, 1996

[54] STAND APPARATUS FOR USE IN COUPLING AND UNCOUPLING A FRONT LOADER

[75] Inventors: Masami Hirooka; Kazuhiko Ikeuchi; Toshihiko Waka, all of Sakai, Japan

[73] Assignee: Kubota Corporation, Osaka, Japan

[21] Appl. No.: 346,865

[22] Filed: Nov. 30, 1994

[30] Foreign Application Priority Data

Mar. 30, 1994 [JP] Japan ..... 6-061604
Jun. 21, 1994 [JP] Japan ..... 6-139169

[51] Int. Cl.[6] ..... A01B 51/00

[52] U.S. Cl. ..... 172/274; 172/273; 414/686

[58] Field of Search ..... 172/272, 273, 172/274, 275; 37/403, 382, 466; 414/686, 545, 694, 695.5; 56/13.6, 192

[56] References Cited

U.S. PATENT DOCUMENTS

| | | | |
|---|---|---|---|
| 3,805,980 | 4/1974 | Kisaka | 414/686 |
| 3,833,136 | 9/1974 | Spicer et al. | 414/686 |
| 3,863,786 | 2/1975 | Frank | 414/686 |
| 3,912,095 | 10/1975 | Miller | 414/686 |
| 3,949,889 | 4/1976 | Moe | 415/686 |
| 4,051,962 | 10/1977 | Westendorf | 414/686 |
| 4,247,242 | 1/1981 | Goertzen | 414/686 |
| 4,257,730 | 3/1981 | Kawakita | 414/686 |
| 4,264,264 | 4/1981 | McMillan et al. | 37/403 X |
| 4,266,906 | 5/1981 | Langenfeld et al. | 414/686 |
| 4,275,984 | 6/1981 | Lenertz | 414/686 |
| 4,304,305 | 12/1981 | Bartel | 414/686 X |
| 4,345,870 | 8/1982 | Anderson et al. | 414/686 |
| 4,347,031 | 8/1982 | Friesen et al. | 414/686 |
| 4,383,793 | 5/1983 | Weir | 414/686 |
| 4,498,839 | 2/1985 | Williams et al. | 172/273 X |
| 4,522,554 | 6/1985 | Williams et al. | 414/686 |
| 4,548,543 | 10/1985 | Lenertz et al. | 172/273 X |
| 4,637,772 | 1/1987 | Stumpe | 414/686 |
| 4,906,160 | 3/1990 | Kaufman et al. | 414/686 |
| 5,135,347 | 8/1992 | Kaczmarczyk et al. | 414/686 |

FOREIGN PATENT DOCUMENTS

| | | | |
|---|---|---|---|
| 0042608 | 12/1981 | European Pat. Off. | 414/686 |
| 2102908 | 8/1990 | Japan | A01B 59/048 |
| 1408669 | 10/1975 | United Kingdom . | |

*Primary Examiner*—Terry Lee Melius
*Assistant Examiner*—Victor Batson
*Attorney, Agent, or Firm*—Webb Ziesenheim Bruening Logsdon Orkin & Hanson, P.C.

[57] ABSTRACT

A stand apparatus for a front loader having masts attachable to mast mounts of a tractor through pivotal supports and mast fixing members, booms connected to the masts, boom cylinders and braces. The stand apparatus includes stand members each defining a slot for receiving a pivotal support disposed in a lower position on each mast, and a stand locking bore formed adjacent thereto. Each stand member is pivotable between an operative position in which a ground engaging end thereof contacts the ground to stand the front loader, and a contained position in which the ground engaging end is supported by the front loader. The pivotal support of each mast is movable in the slot to limit an amount of upward projection of the stand member in the confined position.

8 Claims, 9 Drawing Sheets

STAND APPARATUS FOR USE IN COUPLING AND UNCOUPLING A FRONT LOADER

BACKGROUND OF THE INVENTION

1. Field of the Invention

The present invention relates to a stand apparatus used when a working implement such as a front loader is coupled to and uncoupled from a vehicle such as a tractor.

2. Description of the Related Art (I) A conventional stand apparatus for keeping a front loader standing by itself on the ground is disclosed in Japanese Utility Model Publication Kokai No. 1990-102908, for example. According to this apparatus, a vehicle body includes mast mounts arranged at opposite lateral positions thereof, and fight and left masts pivotally supporting proximal ends of loader booms have lower ends thereof removably attached to the mast mounts, respectively. The masts are interconnected in intermediate positions thereof by a connecting member. Each mast pivotally supports, in a lower portion thereof, a proximal end of a stand member through a cross axis. The stand member is pivotable between an operative position having a ground engaging end thereof contacting the ground and a contained position with the ground engaging end directed upward. The apparatus includes an operative and contained position retaining device for retaining the stand member in each of the operative position and contained position.

When uncoupling the front loader from the tractor, a bucket cylinder must be operated to cause the booms to pivot about forward ends thereof, thereby to raise the lower ends of the masts above the front wheels. The stand apparatus also contributes to raising of the masts at this time. The smaller the masts are, the easier is the operations to couple and uncouple the front loader. This requires the lower ends of the masts to be connected at a relatively high level to the mast mounts. The stand members are longer where the lower ends of the masts are connected at a relatively high level to the mast mounts than where the lower ends; of the masts are connected at a low level. When such long stand members are swung upward to the contained position extending along the masts, the ground engaging ends project a large extent upward and could obstruct the driver's view during an earth moving operation.

(II) In the working implement coupling apparatus noted above, control valves and control levers for controlling boom cylinders may be mounted on the masts with a view to simplification of hydraulic piping or because of a restriction as to installation space. In this case, the driver in the cab provided rearwardly of the masts must operate the control levers from beginning to end of a coupling or uncoupling operation. It is therefore desirable that the masts move a minimal amount forward during the coupling or uncoupling operation. For this purpose, the lower ends of the stand members should be placed as close to the ground as possible when fixing the stand members to the masts.

Further, the tires generally used on tractors include farm tires suited for operations on soft farmland, and turf tires for use on grassland. Where the rim diameter is the same, farm tires with high lugs usually have a larger diameter than turf tires. Consequently, depending on the type of tires attached to the vehicle body, the height of the vehicle body is variable during an operation to couple or uncouple the working implement.

As noted above, the height of the vehicle body is not always the same. In order that the stand members may be fixed to the masts to extend forwardly and downwardly, the fixed position of the stand members relative to the masts must be determined according to the height of the vehicle body having turf tires (i.e. minimum height). For, if the fixed position of the stand members were determined according to the height of the vehicle body having farm tires (i.e. maximum height), the stand members could not be fixed because of the lower ends of the stand members contacting the ground when farm tires are replaced with turf tires.

However, if stand members suited to the height of the vehicle body having turf tires are used also when farm tires are attached, the lower ends of the stand members fixed to the masts will be distanced from the ground by the difference in vehicle height. When the working implement is uncoupled in this state, the masts will tilt a considerable amount forward until the lower ends of the stand members touch the ground. Consequently, the control levers attached to upper positions of the masts will move far from the cab provided rearwardly of the masts. This inconveniences the driver operating the control levers in the cab.

(III) Another disadvantage is that the driver must hold the stand members extending forwardly and downwardly with hands when fixing the stand members to the masts. Thus, the operation to fix the stand members to the masts is troublesome and difficult.

SUMMARY OF THE INVENTION

The present invention intends to overcome the disadvantages of the prior art noted above, which are:

(I) that the stand members in the contained position extend upward to obstruct the driver's view:

(II) that, when uncoupling the front loader from the working vehicle, an operation to extend and contract the boom cylinders or the like is time-consuming and inefficient particularly if the stand members have an increased distance to the ground as a result of a tire change; and (III) that, when uncoupling the front loader from the working vehicle, the stand members extending forwardly and downwardly must be held manually, which leaves room for improvement in operability.

The above objects are fulfilled, according to the present invention, by a stand apparatus for a front loader having masts attachable to mast mounts of a tractor through pivotal supports and mast fixing members, booms connected to the masts, boom cylinders and braces, the stand apparatus comprising cross axes (first pivotal supports) disposed in lower positions of the masts, respectively; first connectors provided on the masts, respectively; stand members; an operative position retaining device for retaining the stand members in an operative position; and a contained position retaining device for retaining the stand members in a contained position; each stand member having a main body defining a slot for receiving one of the first pivotal supports, an extension continuous with the main body, and a ground engaging end formed at an end of the extension; each stand member being pivotable between an operative position in which the ground engaging end contacts the ground to stand the front loader, and a contained position in which the ground engaging end is supported by the front loader; the operative position retaining device including a first connectable member formed on the stand member to be engageable with the first connector, and a stand locking member for establishing engagement between the first connector and the first connectable member; and the contained position retaining device including a second connectable member formed on the ground engaging end, a second connector firmed on the front loader, and a stand retaining member for establishing engagement between the second connector and the second connectable member.

In the stand apparatus having the above construction, the first connectable member of the operative position retaining device may comprise a plurality of bores formed in the main body, and the first connector may comprise a bore formed in each mast. The stand locking member may be extendible through one of the, bores formed in each stand member and the bore formed in each mast, to adjust an amount of downward extension of the stand members.

Further, each stand member may have engaging members formed peripherally of the plurality of bores, and each mast may have a boss formed on a side wall thereof, one of the engaging members engaging the boss when the stand member is placed in the operative position, to counteract an angular moment generated around the first connector, with a weight of the front loader applied to the stand members.

With the front loader coupling apparatus having the above construction, the stand members in the contained position present no obstruction to the driver's view. The stand members have an adjustable distance to the ground when uncoupling the front loader from the working vehicle, thereby to reduce the forward movement of the masts. Thus, where control valves and control levers of the boom cylinders are provided on the masts, the driver may operate the control levers with ease in a cab provided rearwardly of the masts from beginning to end of a loader uncoupling operation. The above construction also accommodates variations in the height of the working vehicle occurring with different types of tires used.

Further, with the engaging members of the stand members engaging the bosses on the masts, the stand members extending forwardly and downwardly need not be supported manually before looking the stand members to the masts. This facilitates an operation to lock the stand members to the masts.

The foregoing and other objects, features and advantages of the invention will be apparent from the following more particular description of the preferred embodiments of the invention, as illustrated in the accompanying drawings.

DETAILED DESCRIPTION OF THE PREFERRED EMBODIMENTS

I.

An embodiment of the present invention will be described with reference to the drawings.

Figure 1A:
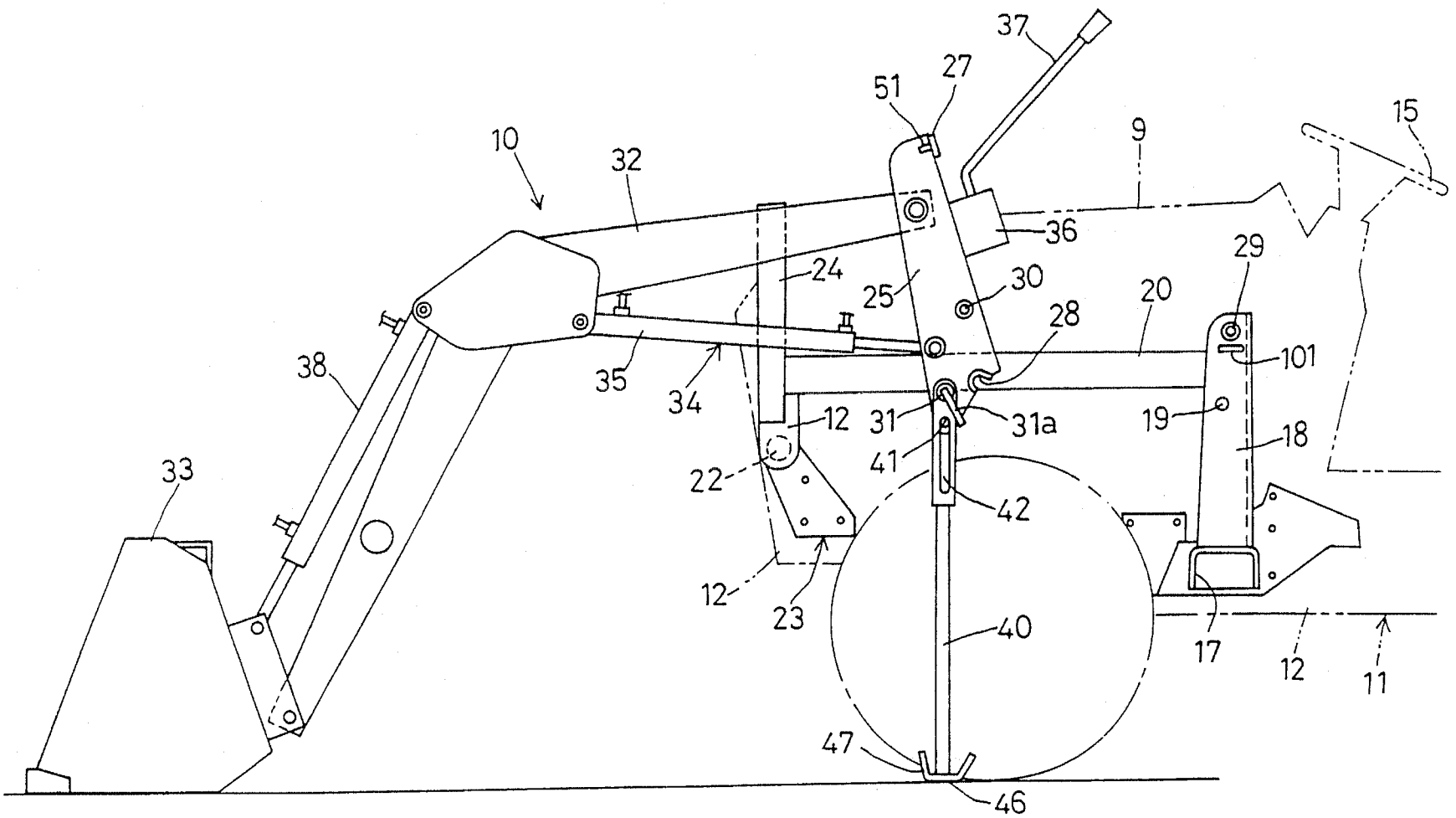
FIG. 1A is a side view of a working implement coupling apparatus having stand member each defining one stand locking bore in a state that a fiat loader is uncoupled.
Figure 1B:
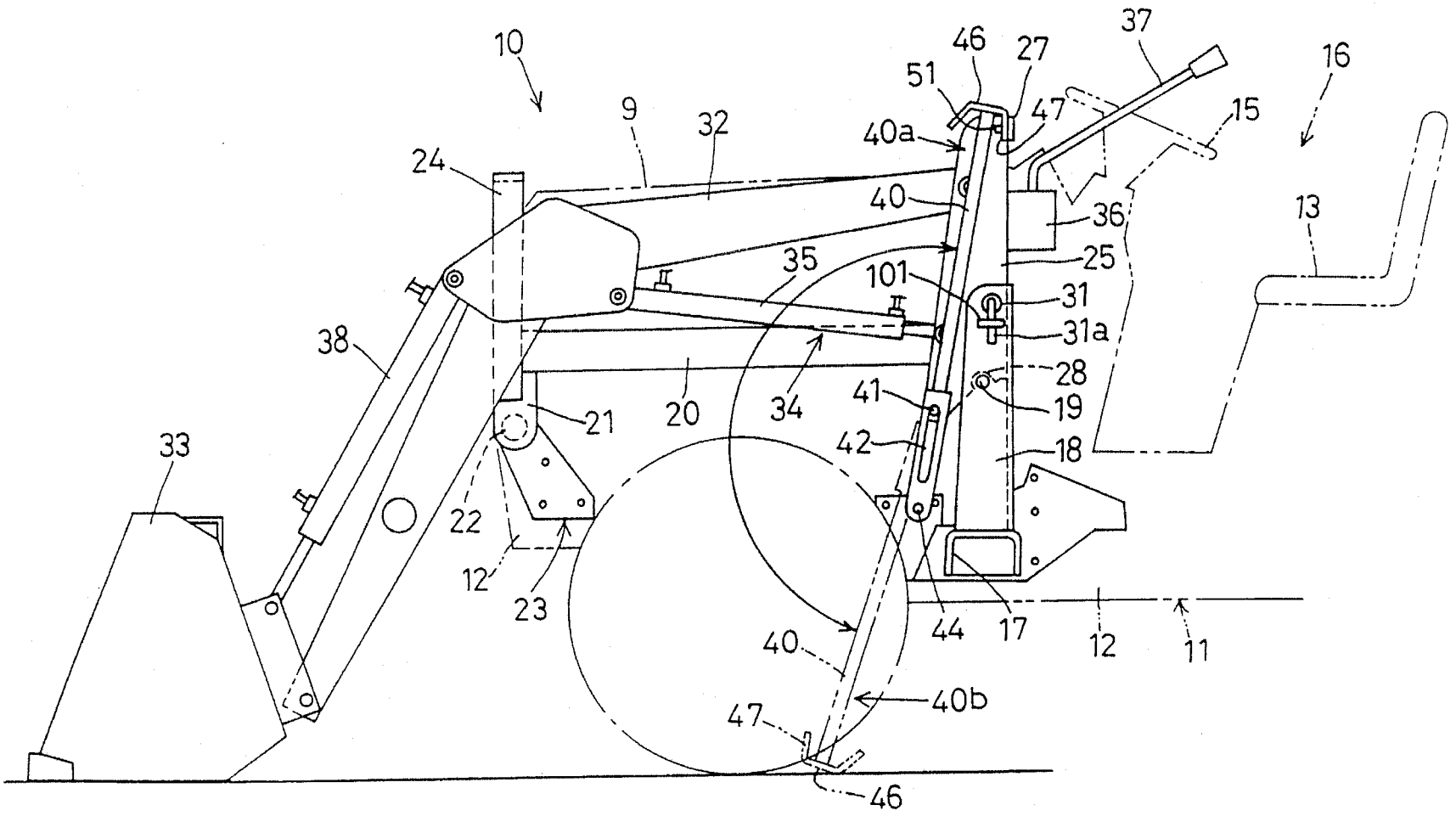
FIG. 1B is a side view of a working implement coupling apparatus having stand member each defining one stand locking bore in a state that a flat loader is coupled.
Figure 4:
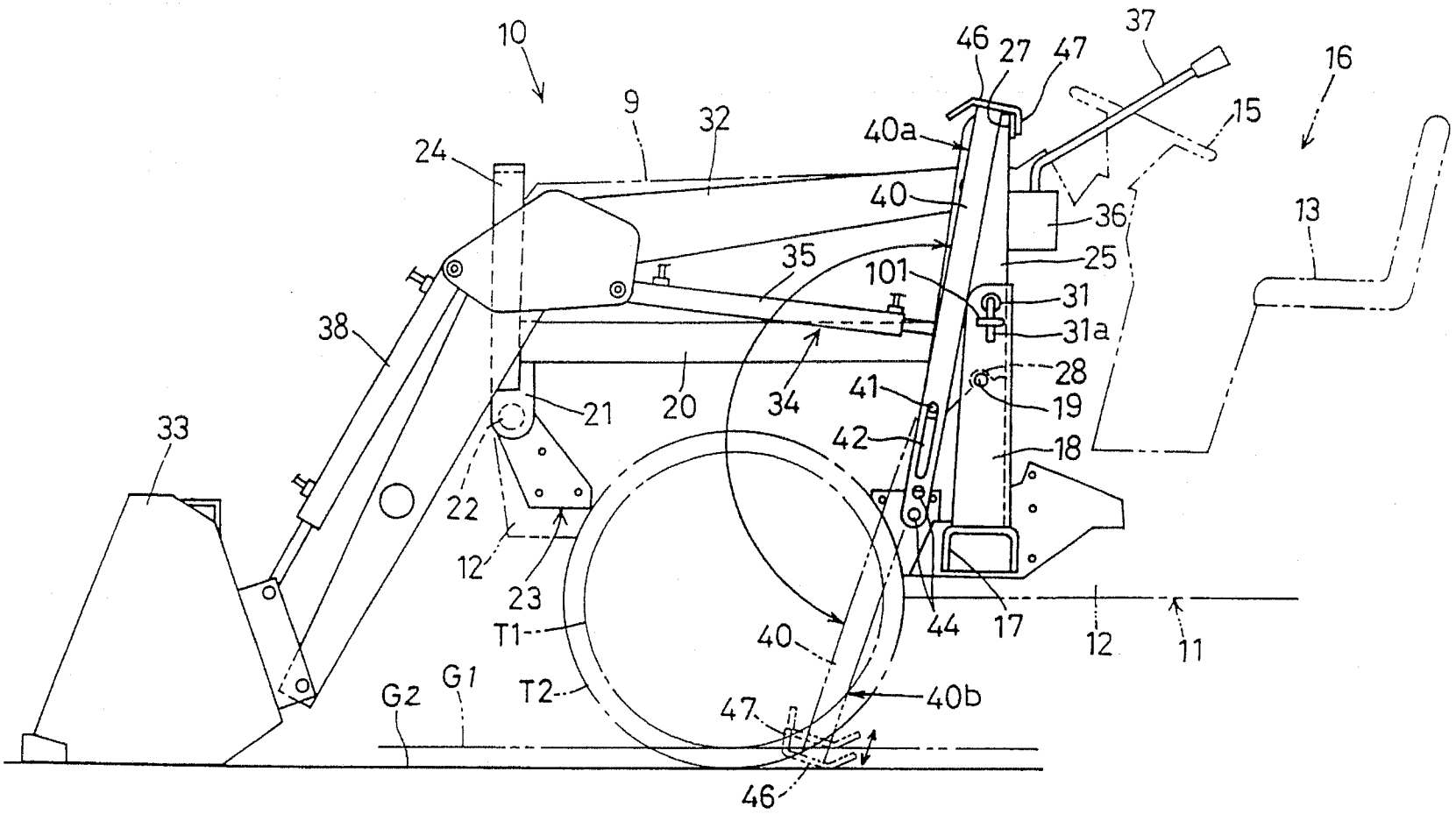
FIG. 4 is a side view of a different embodiment of the invention in which each stand member defines a plurality of stand locking bores.

In FIGS. 1A, 1B, and 4, a working implement 10 exemplified by a front loader is detachably attached to a body 12 of a tractor 11. The tractor body 12 includes a clutch housing, a transmission case, and a front axle frame extending forwardly of an engine. The engine is covered by a hood 9. The tractor body 12 further includes a driver's seat 13 disposed rearwardly of the engine, and a control panel 14 and a steering wheel 15 disposed forwardly of the driver's seat 13. Thus, a cab 16 is provided for the driver to effect various controls of the tractor 10.

Though not shown in the drawings, a backhoe is coupled to a rear end of the tractor body 12. An area over the cabin 16 may be covered with a canopy supported by a plurality of posts fixedly erected on the tractor body 12.

The tractor body 12 has support brackets 17 fixed to opposite lateral positions thereof, and a mast mount 18 is fixedly mounted on each support bracket 17. Thus, mast mounts 18 are attached to the tractor body 12 through the support brackets 17.

Figure 2:
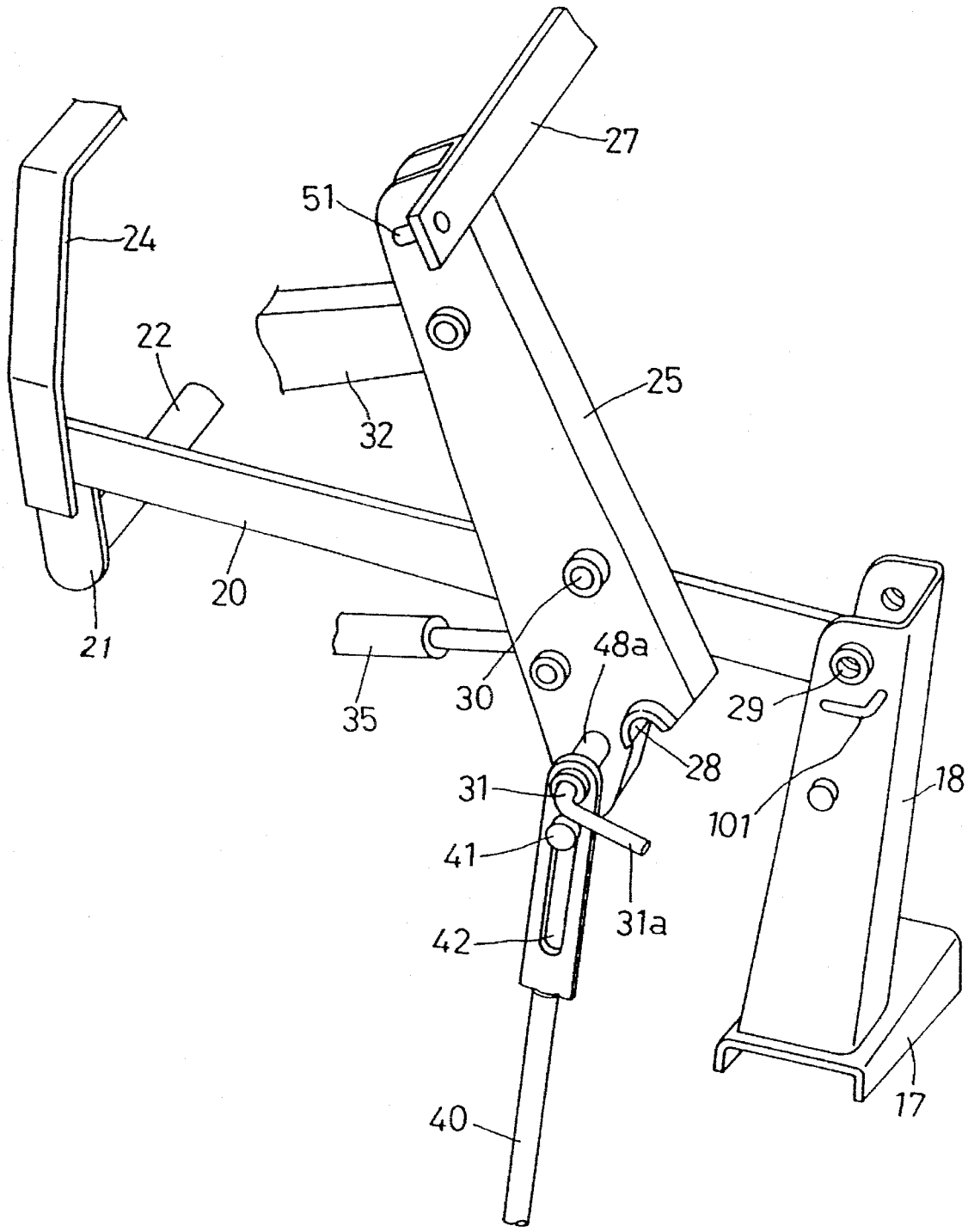
FIG. 2 is a perspective view of the embodiment of FIG. 1A, showing a state in which a front loader is uncoupled.
Figure 3:
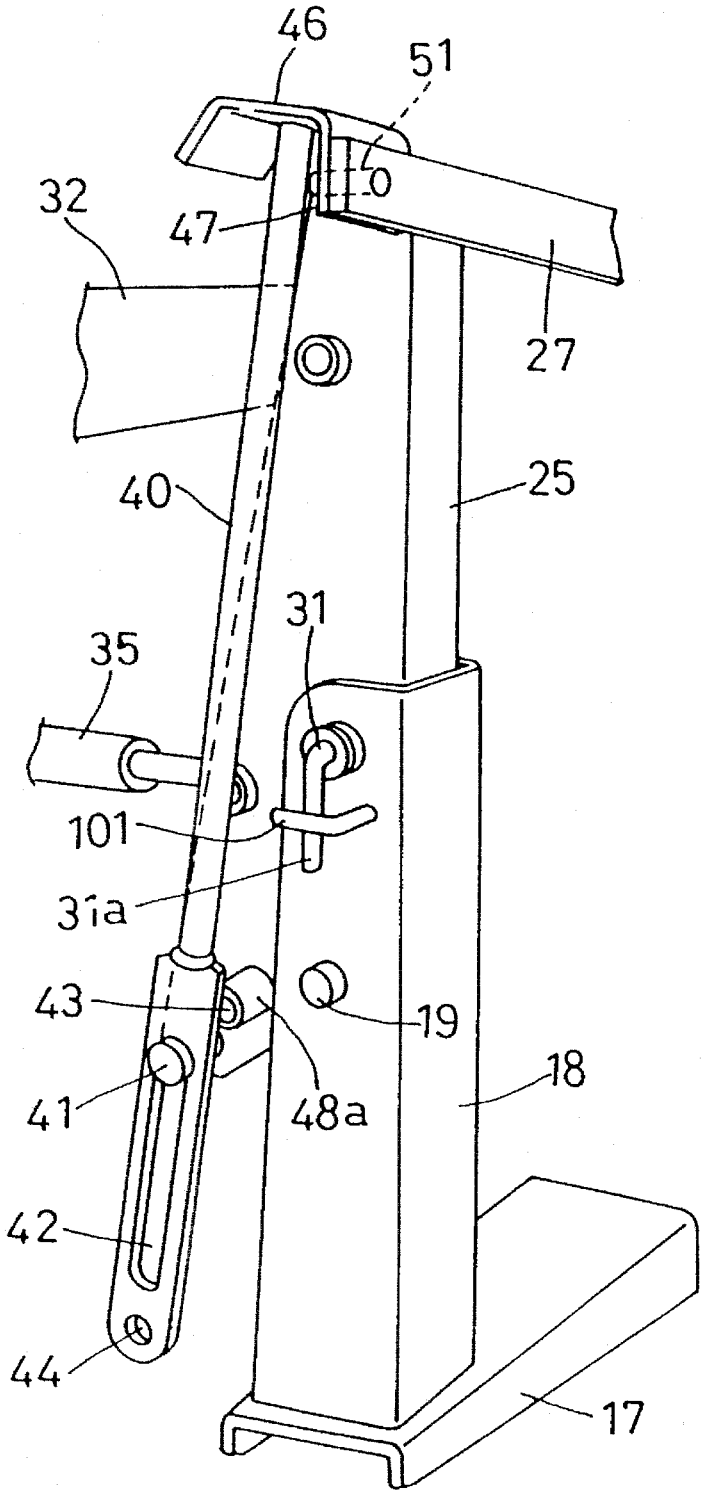
FIG. 3 is a perspective view of the embodiment of FIG. 1B, showing a state in which the front loader is coupled.

As seen from FIGS. 2 and 3, each mast mount 18 has an approximately U-shaped cross section opening forward, and includes a fixed support pin 19 extending transversely through vertically intermediate positions thereof. Further, each mast mount 18 has a brace 20 fixed to and extending forward from an intermediate position thereof.

A flat-plate bracket 21 is fixed to a forward end of each of the fight and left braces 20. The brackets 21 of the fight and left braces 20 are interconnected through a connecting member 22 formed of pipe. The connecting member 22 is fixed to a :front position of the tractor body 12 by a fixing device 23 including brackets and bolts. A protector 24 is connected to the forward ends of the fight and left braces 20 through the brackets 21 for protecting the engine and the like from a head-on collision.

Figure 6:
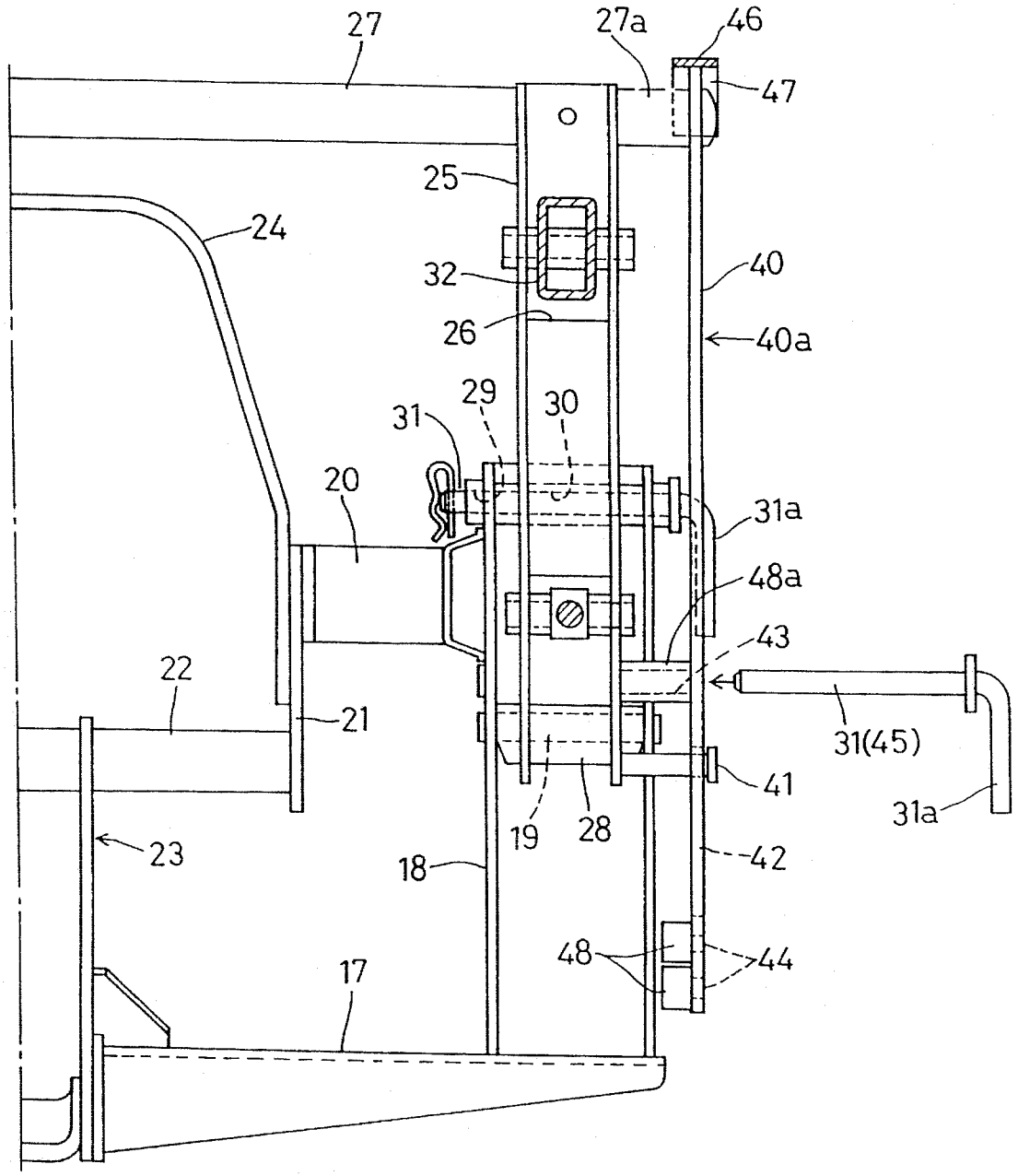
FIG. 6 is a front view of the portion shown in FIG. 5.

The working implement 10 includes a pair of right and left masts 25 detachably attachable to the tractor body 12. Each mast 25 has an approximately U-shaped cross section opening forward, with a reinforcing member 26 welded to vertically intermediate inside walls thereof as shown in FIG. 6. The right and left masts 25 are interconnected through an elongate connecting member 27 extending transversely and fixed to rear surfaces at upper ends thereof. The connecting member 27 has opposite ends thereof slightly projecting fight and left from the masts 25. Each mast 25 has an engaging recess 28 formed in a lower position and opening downward.

The engaging recess 28 of each mast 25 is movable downward into fitting engagement with the pivotal support (or support pin) 19 of the mast mount 18. Thus, the mast 25 is supported by the mast mount 18 to be pivotable about the pivotal support (or support pin) 19 toward a lower forward position, and detachable forwardly and upwardly.

Each mast mount 18 has pin receiving bores 29 formed transversely through upper positions thereof, while each mast 25 has pin receiving bores 30 formed in vertically intermediate positions thereof to register with the pin receiving bores 29 of the mast mount 18. The mast 25 is fixed to the mast mount 18 by a lock pin 31 extending through the bores 29 and 30. In this embodiment, therefore, the lock pins 31 act as a mast locking device 31 for detachably attaching the masts 25 to the mast mounts 28 in a way to prevent the masts 25 from becoming detached forwardly and upwardly and pivoting toward a lower forward position.

The front loader includes booms 32 having proximal ends thereof pivotally connected to the upper ends of masts 25. The booms 32 extend forwardly from the masts 25, and are bent in an intermediate position to extend forwardly and downwardly. A working tool 33 exemplified by a bucket is pivotally connected to forward ends of the booms 32.

Each boom 32 is vertically pivotable relative to the masts 25 by a boom drive device 34. The boom drive device 34 includes boom cylinder 35 extending between an intermediate position of the boom 32 and a lower position of the mast 25, and a hydraulic circuit for extending and contracting the boom cylinder 35. The hydraulic circuit includes a hydraulic valve 36 fixed to an upper rear wall of the mast 25 for controlling oil supply to the boom cylinder 35.

The hydraulic valve 36 is operable by a control lever 37 to actuate the drive device 34, the control lever 37 extending from an upper position of the mast 25 rearwardly into the cab 16. Thus, the control lever 37 is operable by the driver seated in the driver's seat 13.

The bucket 33 is vertically pivotable relative to the booms 32 by extension and contraction of a bucket cylinder 38. The hydraulic valve 36 controls oil supply to the bucket cylinder 38 also.

Each mast 25 has an elongate stand member 40 connected thereto. The stand member 40 is movable between a contained position **40*a* to extend along a side wall of the mast 25, and an operative position 40*b* to extend forwardly and downwardly from the mast 25**.

A structure for connecting the stand member 40 will be described with reference to FIGS. 1 through 3. Each mast 25 has a first pivotal support (or holder pin) 41 projecting from a lower lateral wall thereof, while each stand member 40 has a guide slot 42 formed adjacent a proximal end thereof. The holder pin 41 acting as the pivotal support extends through the guide slot 42 to connect the, stand member 40 to the mast 25 to be pivotable and slidable relative thereto. Thus, the stand member 40 is pivotable upward to the contained position **40*a* and downward to the operative position 40*b***.

When the stand member 40 is in the operative position, a pin receiving bore 44 formed therein to act as a first connectable device may be opposed to a pin receiving bore 43 (shown in FIG. 3) formed in the mast 25 to act as a first connecting; device. The pin receiving bore 44 may have the same diameter as the pin receiving bores 29 and 30 of the mast 25 and mast mount 18 to share the lock pin 31. Of course the pin receiving bore 44 may have a different diameter to the pin receiving bore 29 of the mast mount 18, with different (first and second) leek pins used for the respective bores 44 and 29. With the lock pin extending through these pin receiving bores, the stand member 40 is locked by the lock pin 31 and the holder pin 41 acting as the pivotal support, to the position shown in FIG. 2. The lock pin acting as the locking device, the pin receiving bores acting as the first connecting device and the first connectable device constitute an operative position retaining device.

As shown in FIGS. 2 and 3, the lock pin 31 has a grip rod **31*a* welded to a head there, of, while the mast mount 18 includes a catch 101. The catch 101 engages the grip rod 31*a* when the lock pin 31 is passed through the pin receiving bores and turned therein, to retain the lock pin 31** in place.

When the lock pin 31 is pulled out, the stand member 40 is movable within the length of slot 42 relative to the first pivotal support (or holder pin) 41. When an end of the slot 42 opposed to a ground engaging end 46 of the stand member 40 contacts the first pivotal support (or holder pin) 41, the first pivotal support (or holder pin) 41 and ground engaging end 46 have a reduced distance therebetween. In this state the stand member 40 may be swung upward to the contained position, so that the ground engaging end 46 of the stand member 40 extends a limited amount upward. In this position, the ground engaging end 46 lies close to the connecting member 27.

FIG. 4 shows a modified stand member. As described in the introductory part hereof, the working vehicle has a varied height, depending on whether turf tires or farm tires are used. This stand apparatus is well suited for standing the front loader where the working vehicle has a varied height. In the preceding embodiment, the stand member 40 has the single pin receiving bore 44 for locking the stand member 40 to the operative position. This embodiment provides a plurality of pin receiving bores 44 to act as the first connectable device. Which of the fixing bores (pin receiving bores) 44 is to be used is determined according to the type of front wheels attached to the tractor body 12. When the front wheels have turf rims T1, the tractor has a reduced height, with the ground G1 lying close to the tractor body 12 as shown in a two-dot-and-dash line in FIG. 4. In this case, the lower locking bore (pin receiving bore) 44 is used to lock the stand member 40 so that the stand member 40 extends a reduced amount forward and downward.

When the front wheels have farm tires T2, the tractor has an increased height, with the ground G1 lying far from the tractor body 12 as shown in a solid line in FIG. 4. In this case, the upper locking bore (pin receiving bore) 44 is used to lock the stand member 40 so that the stand member 40 extends an increased amount forward and downward.

Thus, whichever type of tire is used, the stand member 40 may be locked to the mast 25 with the lower end of the stand member 40 lying close to, preferably in light contact with, the ground. The stand member 40 may extend a variable amount to the ground, which is achieved by providing a plurality of bolts to be placed in the slot of the stand member, with the mast defining bores corresponding to these bolts.

The stand member 40 includes a broad ground engaging plate 46 mounted at the distal end thereof. This plate 46 prevents the stand member 40 in the operative position **40*b* from sinking into the ground. The ground engaging plate 46 includes an engaging portion 47 for hooking on to an end of the connecting member 27 fixed to the mast 25 when the stand member 40 is in the contained position 40*a*. The ground engaging plate 46 acts also as a positioning member when the stand member 40 is in the contained position 40*a* connected to the mast 25**.

The stand member 40 in FIG. 4 has a different configuration to the preceding embodiment (FIG. 1 ), but this is merely a matter of design choice in the present invention.

FIGS. 7 through 11 show examples of contained position retaining device for retaining the stand member in the contained position. It is to be noted that these examples are applicable to both of the embodiments shown in FIGS. 1A, 1B, and 4.

Figure 7:
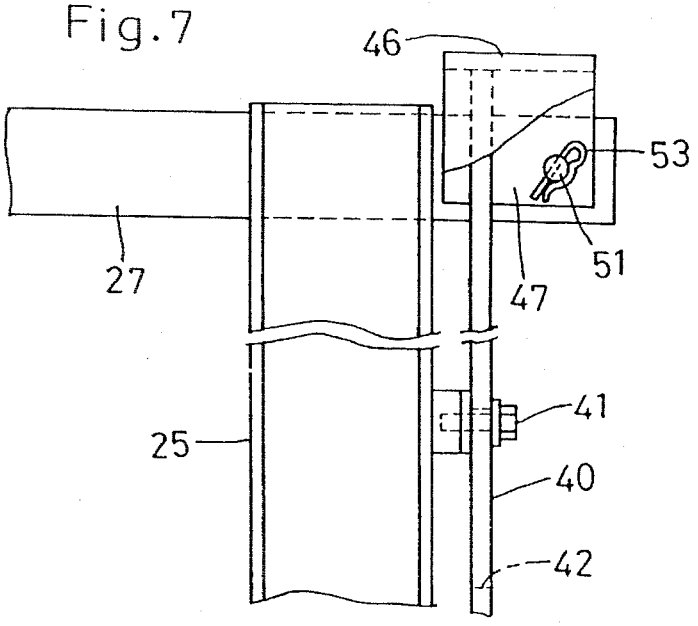
FIG. 7 is a front view showing an example of structures for attaching each stand member to a mast.
Figure 8:
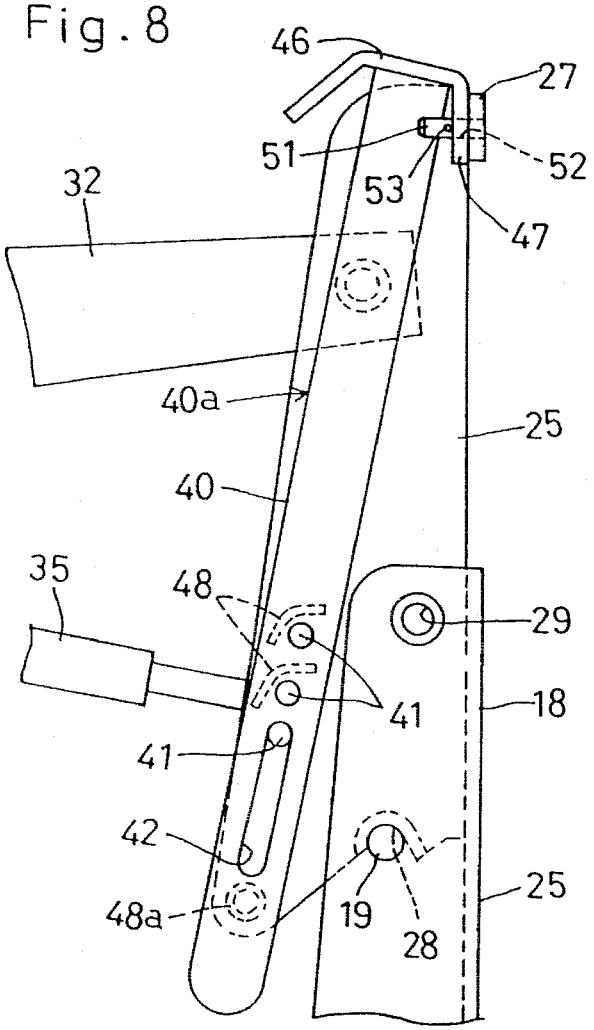
FIG. 8 is a right side view of the structure shown in FIG. 7.

As shown in FIGS. 7 and 8, a contained position retaining device includes mounting pins 51 provided on front surfaces at opposite, fight and left, ends of the connecting member 27 to act as second connecting members, and pin receiving bores 52 formed in the engaging portions 47 of the ground engaging plates 46 to act as second connectable members for receiving the mounting pins 51. Each stand member 40 may be locked to the contained position 40*a* by inserting the mounting pin 51 through the pin receiving bore 52, and then removably attaching a beta pin (beta-shaped pin) 53 to a distal end of the mounting pin 51 to act as a retainer. This construction allows a locking operation to be carded out easily and quickly since the stand member 40 may be locked simply by manipulating the beta pin 53. In the embodiment shown in FIGS. 4 and 5, the holder pin 41 is formed of a bolt screwed to a side wall of the mast 25 through a collar (not shown).

Figure 9:
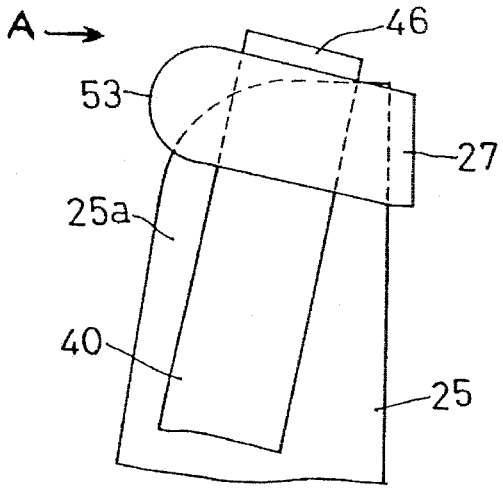
FIG. 9 is a left side view showing another example of structures for attaching each stand member to a mast.
Figure 10:
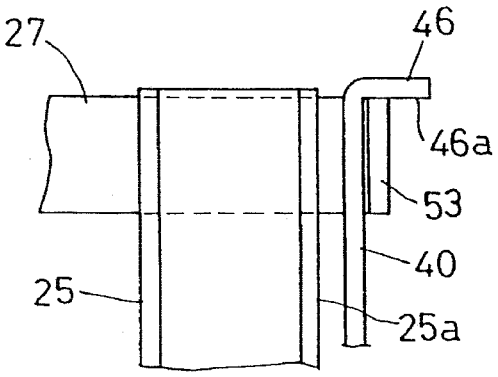
FIG. 10 is a view seen in a direction of arrow A in FIG. 9.

FIGS. 9 and 10 show a different contained position retaining device. The connecting member 27 has supports 53 extending forwardly from opposite, right and left, ends thereof, each support 53 defining a space with a side wall 25*a* of the mast 25 to receive the stand member 40. Each stand member 40 has a ground engaging plate 46 extending laterally outwardly from a distal end thereof to engage an upper surface of the support 53 of the ground engaging plate 46. The upper surface of the support 53 slopes rearwardly whereby the stand member 40 in the contained position 40*b* is biased, by gravity, in a direction to, engage a ground engaging surface 46*a* of the ground engaging plate 46 with the support 53. This prevents the ground engaging plate 46 from moving out of engagement with the support 53. In this embodiment, the sloping surfaces act as the second connecting members, the ground engaging plates 46 as the second connectable members, and the ground engaging surfaces 46*a* as the retainers, which constitute the contained position retaining device.

Figure 11:
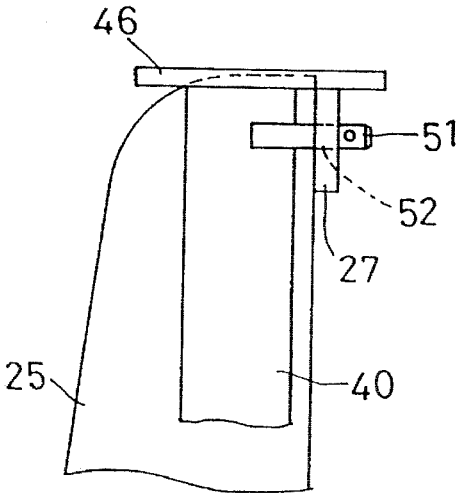
FIG. 11 is a right side view showing a further example of structures for attaching each stand member to a mast.

As shown in FIG. 11, the ground engaging plate 46 of each stand member 40 may have a slightly increased length to extend rearwardly. The stand member 40 may have a vertical position set by this ground engaging plate 46 resting on an end of the connecting member 27. Further, the stand member 40 has a mounting pin 51 acting as the second connectable member to be inserted into a pin receiving bore 52 of the connecting member 27 acting as the second connecting member. According to this construction, the mounting pin 51 and pin receiving bore 52 may be brought into alignment with ease. A beta pin or the like may be provided at a distal end of the mounting pin 51 to act as the retainer for retaining the mounting pin 51 in the pin receiving bore 52.

Figure 12:
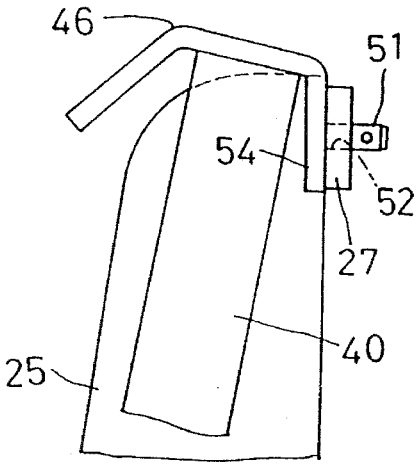
FIG. 12 is a right side view showing a still further example of structures for attaching each stand member to a mast.

As shown in FIG. 12, the ground engaging plate 46 may include a bent piece 54 for fitting on the connecting member 27, with the mounting pin 51 attached to the bent piece 54.

Figure 5:
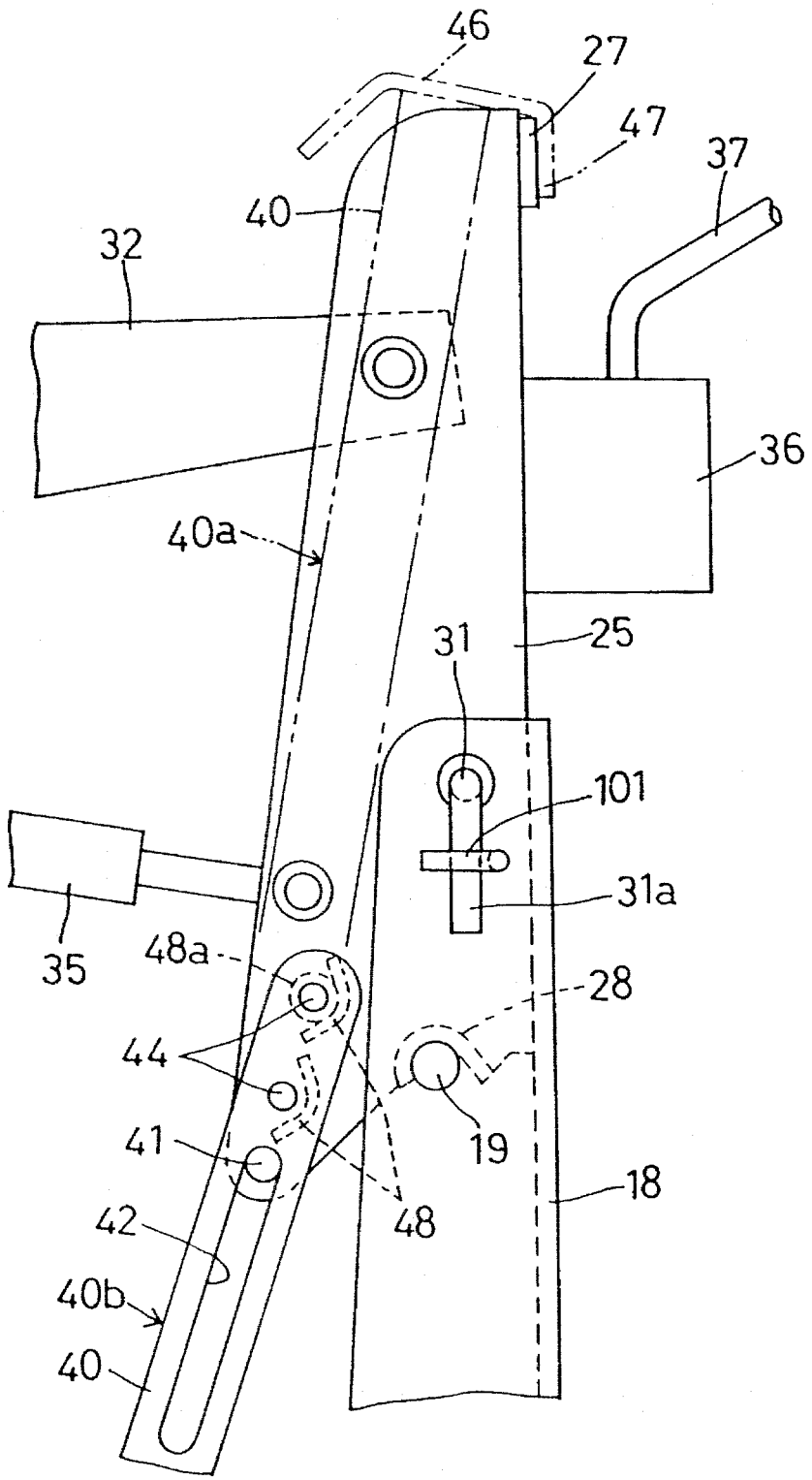
FIG. 5 is an enlarged view of a principal portion of FIG. 4.

In the embodiments shown in FIGS. 1A, 1B, and 4, each stand member 40 may preferably include engaging members 48 disposed adjacent the pin receiving bores 44 as shown in FIGS. 5 and 6. The engaging members 48 engage an outer periphery of a boss 48*a* under a moment produced about the holder pin 41 by the gravity of the stand member 40 in the operative position 40*b*, thereby to retain the stand member 40 in the operative position 40*b*.

Specifically, each engaging member 48 has an engaging surface extending along half the circumference of the boss 48*a*. The boss 48*a* fits in the engaging member 48 when the stand member 40 pivots downward from the contained position 40*a* to the operative position 40*b*.

Thus, when the ground engaging plate 46 of the stand member 40 in the contained position 40*a* is disengaged from the connecting member 27, the stand member 40 pivots downward and at the same time slides downward relative to the mast 25 by gravity. Then the engaging member 48 of the stand member 40 automatically engages the boss 48*a* of the mast 25, whereby the stand member 40 is retained in the operative position 40*b*. The driver need not support the stand member 40 with a hand when fixing the stand member 40 to the mast 25. A stand locking device (lock pin) 45 may simply be inserted through the boss 48*a* and pier receiving bore 44.

As noted above, the lock pin acting as the stand locking device may be provided separately from the lock pin acting as the mast locking device.

In the above embodiment, the engaging members 48 are provided for the two pin receiving bores. However, an engaging member may be provided for only one of the pin receiving bores.

II.

An operation to uncouple the working implement 10 in the foregoing embodiments will be described next.

As noted hereinbefore, the embodiment shown in FIGS. 1A and 1B includes one bore 44 for locking the stand member 40, while the embodiment shown in FIG. 4 includes a plurality of such bores 44 so that the stand member 40 may extend a variable amount to enable use of the two types of tires. The two embodiments are the same in the other aspects. The loaders in the embodiments of FIGS. 1A, 1B, and 4 are detachable in substantially the same manner. Thus, a loader uncoupling operation will be described by referring to FIGS. 1A, 1B, and 4 in parallel.

The driver in the cab 16 first operates the control levers 37 to lower the booms 32 and place the working tool 33 attached to the forward ends of the booms 32 in contact with the ground. Then, the driver pulls out the lock pins 31 to release the masts 25 from the mast mounts 18, whereby the masts 25 become pivotable forward relative to the mast mounts 18 and detachable forward and upward from the mast mounts 18.

On the other hand, the stand members 40 are moved from the contained position 40*a* to the operative position 40*b* and fixed to the latter. FIGS. 2 and 3 show the operative position and contained position of each stand member in the embodiment of FIGS. 1A and 1B respectively. In the case of the stand member 40 in the embodiment shown in FIG. 4, one of the pin receiving bores 44 is selected in advance according to vehicle height, to adjust an amount each stand member 40 extends forwardly and downwardly from the mast 25, so that the forward end of each stand member 40 lies close to the ground. This stand fixing step may be carded out before all the other steps.

With a further operation of the control levers 37 to extend the boom cylinders 35, each mast 25 pivots forward about the support pin 19 (pivotal point) until the forward end of the stand member 40 fully contacts the ground forwardly of the proximal end thereof. In the embodiment shown in FIG. 4, the forward end of each stand member 40 is placed close to the ground according to the vehicle height when the stand member 40 is fixed. Consequently, the masts 25 are inclined a limited amount forward, allowing the control levers 37 to be disposed relatively close to the cab 16.

The boom cylinders 35 are extended further for causing the stand members 40 to pivot about the forward ends thereof from a position extending forwardly and downwardly to an upright position. At this time, the proximal ends of the stand members 40 move forward and upward, whereby the masts 25 are separated forward and upward from the mast mounts 18.

Subsequently, hydraulic piping and the like are uncoupled, and the tractor 11 is driven backward to complete the operation to uncouple the working implement 10.

The working implement 10 is coupled to the tractor 11 in a sequence reversed from the above.

The present invention is not limited to the foregoing embodiments but may be modified as appropriate.

In the foregoing embodiments, each mast 25 has one boss 48*a*, while each stand member 40 has two pin receiving bores 44 selectively used to adjust an amount of forward and downward extension of the stand member 40. This construction may be modifies such that, for example, each mast 25 has two bosses 48*a* and each stand member 40 has one pin receiving bore 44, to enable a similar adjustment by selectively using the bosses 48*a*.

According to the present invention, as described hereinbefore, each stand member defines a slot for receiving the first pivotal support (holder pin) and extending toward the ground engaging end. The stand member may be connected to the mast by a first connector (first connecting device, first connectable device and stand locking device) when the cross axis (first pivotal support) acting as the contained position retaining device lies in the slot adjacent the ground engaging end of the stand member. Consequently, the stand member in the contained position may lie low to present no obstruction to the driver's field of view or to an earth moving operation even though the stand member is long and the lower end of the mast is at a high level to stabilize coupling and uncoupling of the loader.

Further, when uncoupling the working implement, according to the present invention, each stand member is locked in a forwardly and downwardly extending posture to, the mast after its amount of extension is adjusted so that the forward end of the stand member lies as close to the ground as possible. Thus, the mast tilts a small amount forward until the forward end of the stand member contacts the ground forwardly of the proximal end of the stand member. The mast may finally be detached through a reduced amount of forward movement of the upper end of the mast, and the control lever attached to an upper position of the mast may also be moved only a small amount forward. Thus, the control levers may be operated with facility in the cab from beginning to end of the uncoupling operation.

There is no possibility of losing the stand members as long as the stand members remain connected to the masts. The working implement may be uncoupled easily and quickly since this operation only requires each stand member to pivot downward and to be locked to the mast with the lock pin. When locking the stand member to the mast with the lock pin, the engaging member formed on the stand member, under gravity, engages the periphery of the boss on the mast to retain the stand member in the contained position. The stand member need not be supported manually, to allow the locking operation to be carried out easily and quickly.

What is claimed is:

1. A stand apparatus for a front loader having masts attachable to mast mounts of a tractor through pivotal supports and mast fixing members, booms connected to the masts, boom cylinders and braces, said stand apparatus comprising:

first pivotal supports disposed in lower positions of said masts, respectively;

first connectors provided on said masts, respectively;

stand members each having:

a main body defining a slot for receiving one of said first pivotal supports;

an extension continuous with said main body; and a ground engaging end formed at an end of said extension;

each of said stand members being pivotable between an operative position in which said ground engaging end contacts the ground to stand said front loader, and a contained position in which said ground engaging end is supported by said front loader;

operative position retaining means including a first connectable member formed on each of said stand members to be engageable with said first connector, and a stand locking member for establishing engagement between said first connector and said first connectable member; and contained position retaining means including a second connectable member formed on said ground engaging end, a second connector formed on said from loader, and a stand retaining member for establishing engagement between said second connector and said second connectable member.

2. A stand apparatus as defined in claim 1, wherein said mast fixing member and said stand locking member are the same member.

3. A stand apparatus as defined in claim 1, wherein said first connectable member comprises a plurality of bores formed in said main body, and said first connector comprises a bore formed in said mast for aligning with one of said plurality of bores.

4. A stand apparatus as defined in claim 3, wherein said stand locking member comprises a pin extendible through one of said plurality of bores formed in each of said stand members and said bore formed in each of said masts, to adjust an amount of downward extension of said stand members.

5. A stand apparatus as defined in claim 3, wherein each of said stand members has approximately U-shaped projections formed peripherally of said plurality of bores, and each of said masts has a boss formed around an entire circumference of said bore in the mast, one of said projections engaging a periphery of said boss when the stand member is placed in said operative position, so that said front loader may stand without using said fixing member, with a weight of the front loader applied to said stand members.

6. A stand apparatus for a front loader having masts attachable to mast mounts of a tractor through pivotal supports and mast fixing members, booms connected to the masts, boom cylinders and braces, said stand apparatus comprising:

first pivotal supports disposed in lower positions of said masts, respectively, first connectors provided on said masts, respectively;

stand members each having:

a main body defining a slot for receiving one of said first pivotal supports;

an extension continuous with said main body; and a ground engaging end formed at an end of said extension;

each of said stand members being pivotable between an operative position in which said ground engaging end contacts the ground to stand said front loader, and a contained position in which said ground engaging end is supported by said front loader;

operative position retaining means including a first connectable member formed on each of said stand members to be engageable with said first connector, and a stand locking member for establishing engagement between said first connector and said first connectable member; and contained position retaining means including a second connectable member formed on said ground engaging end, a second connector formed on said front loader, and a stand retaining member for establishing engagement between said second connector and said second connectable member, wherein said second connector comprises a projection formed on a connecting member interconnecting a pair of right and left masts, said second connectable member comprises an extension adjacent said ground engaging end and defining a bore for receiving said projection, and said stand retaining member comprises a pin for retaining said projection in said bore.

7. A stand apparatus for a front loader having masts attachable to mast mounts of a tractor through pivotal supports and mast fixing members, booms connected to the masts, boom cylinders and braces, said stand apparatus comprising:

first pivotal supports disposed in lower positions of said masts, respectively;

first connectors provided on said masts, respectively;

stand members each having:

a main body defining a slot for receiving one of said first pivotal supports;

an extension continuous with said main body; and a around engaging end formed at an end of said extension;

each of said stand members being pivotable between an operative position in which said around engaging end contacts the ground to stand said front loader, and a contained position in which said ground engaging end is supported by said front loader;

operative position retaining means including a first connectable member formed on each of said stand members to be engageable with said first connector, and a stand locking member for establishing engagement between said first connector and said first connectable member; and contained position retaining means including a second connectable member formed on said ground engaging end, a second connector formed on said front loader, and a stand retaining member for establishing engagement between said second connector and said second connectable member, wherein said second connector comprises a connecting member interconnecting a pair of right and left masts and defining a bore, said second connectable member comprises a projection formed on an extension of said ground engaging end for extending into said bore, and said stand retaining member comprises a pin for retaining said projection in said bore.

8. A stand apparatus for a front loader having masts attachable to mast mounts of a tractor through pivotal supports and mast fixing members, booms connected to the masts, boom cylinders and braces, said stand apparatus comprising:

first pivotal supports disposed in lower positions of said masts, respectively;

first connectors provided on said masts, respectively;

stand members each having:

a main body defining a slot for receiving one of said first pivotal supports;

an extension continuous with said main body; and a ground engaging end formed at an end of said extension;

each of said stand members being pivotable between an operative position in which said ground engaging end contacts the ground to stand said front loader, and a contained position in which said ground engaging end is supported by said front loader;

operative position retaining means including a first connectable member formed on each of said stand members to be engageable with said first connector, and a stand locking member for establishing engagement between said first connector and said first connectable member; and contained position retaining means including a second connectable member formed on said ground engaging end, a second connector formed on said front loader, and a stand retaining member for establishing engagement between said second connector and said second connectable member, wherein said second connector comprises an inclined surface formed on a connecting member interconnecting a pair of right and left masts, said second connectable member comprises an extension of said ground engaging end, and said stand retaining member comprises an opposed surface formed on said extension for retaining said inclined surface in contact with said extension to be inseparable under a weight of said stand members.

* * * * *

UNITED STATES PATENT AND TRADEMARK OFFICE

CERTIFICATE OF CORRECTION

PATENT NO. : 5,540,289

DATED : July 30, 1996

INVENTOR(S) : Masami Hirooka, Kazuhiko Ikeuchi and Toshihiko Waka

It is certified that error appears in the above-indentified patent and that said Letters Patent is hereby corrected as shown below:

Title page, item '[57] ABSTRACT', Line 13 "confined" should read --contained--.

Column 1 Line 18 "fight" should read --right--.

Column 1 Line 41 "ends;" should read --ends--.

Column 2 Line 35 "view:" should read --view;--.

Column 3 Line 4 "firmed" should read --formed--.

Column 3 Line 13 "the," should read --the--.

Column 3 Line 39 "looking" should read --locking--.

Column 3 Line 50 "fiat" should read --flat--.

Column 4 Line 45 "fight" should read --right--.

Column 4 Line 45 "fight" should read --right--.

Column 4 Line 48 "a :front" should read --a front--.

Column 4 Line 50 "fight" should read --right--.

Column 4 Line 62 "fight" should read --right--.

UNITED STATES PATENT AND TRADEMARK OFFICE

CERTIFICATE OF CORRECTION

PATENT NO. : 5,540,289

DATED : July 30, 1996

INVENTOR(S) : Masami Hirooka, Kazuhiko Ikeuchi and Toshihiko Waka

It is certified that error appears in the above-indentified patent and that said Letters Patent is hereby corrected as shown below:

Column 5 Line 49 "the," should read --the--.

Column 5 Line 57 "connecting;" should read --connecting--.

Column 5 Line 62 "leek" should read --lock--.

Column 6 Line 4 "there, of," should read --thereof,--.

Column 6 Line 31 "rims" should read --tires--.

Column 7 Line 3 "fight" should read --right--.

Column 7 Line 11 "carded" should read --carried--.

Column 7 Line 27 "to," should read --to--.

Column 8 Line 9 "pier" should read --pin--.

Column 8 Line 46 "carded" should read --carried--.

Column 9 Line 28 "to," should read --to--.

UNITED STATES PATENT AND TRADEMARK OFFICE

CERTIFICATE OF CORRECTION

PATENT NO. : 5,540,289

DATED : July 30, 1996

INVENTOR(S) : Masami Hirooka, Kazuhiko Ikeuchi and Toshihiko Waka

It is certified that error appears in the above-indentified patent and that said Letters Patent is hereby corrected as shown below:

Claim 1 Line 14 Column 10 "from" should read --front--.

Claim 6 Line 47 Column 10 "respectively," should read --respectively;--.

Claim 7 Line 25 Column 11 "around" should read --ground--.

Claim 7 Line 28 Column 11 "around" should read --ground--.

Signed and Sealed this

Fifth Day of November, 1996

*Attest:*

*Attesting Officer*

Bruce Lehman

BRUCE LEHMAN

*Commissioner of Patents and Trademarks*